United States Patent [19]

Reichel

[11] Patent Number: 4,888,807

[45] Date of Patent: Dec. 19, 1989

[54] VARIABLE PATTERN MICROPHONE SYSTEM

[75] Inventor: Kenneth R. Reichel, Hudson, Ohio

[73] Assignee: Audio-Technica U.S., Inc., Stow, Ohio

[21] Appl. No.: 298,068

[22] Filed: Jan. 18, 1989

[51] Int. Cl.[4] ..... H04R 3/00

[52] U.S. Cl. ..... 381/92; 387/113; 387/170

[58] Field of Search ..... 381/92, 113, 26, 169, 381/170

[56] References Cited

U.S. PATENT DOCUMENTS

| | | | |
|---|---|---|---|
| 4,042,779 | 8/1977 | Craven et al. | 381/103 |
| 4,072,821 | 2/1978 | Bauer . | |
| 4,258,235 | 3/1981 | Watson | 381/191 |
| 4,308,425 | 12/1981 | Momose et al. . | |
| 4,334,740 | 6/1982 | Wray . | |
| 4,354,059 | 10/1982 | Ishigaki et al. . | |
| 4,412,097 | 10/1983 | Ishigaki et al. . | |
| 4,485,484 | 11/1984 | Flanagan . | |
| 4,491,697 | 1/1985 | Tanaka et al. | 381/113 |
| 4,521,908 | 6/1985 | Miyaji et al. . | |
| 4,559,642 | 12/1985 | Miyaji et al. . | |
| 4,653,102 | 3/1987 | Hansen . | |
| 4,675,906 | 6/1987 | Sessler et al. | 381/92 |
| 4,703,506 | 10/1987 | Sakamoto et al. . | |
| 4,757,545 | 7/1988 | Rosander . | |

*Primary Examiner*—Forester W. Isen
*Attorney, Agent, or Firm*—Welsh & Katz, Ltd.

[57] ABSTRACT

A microphone system including a plurality of sound transducers integrally contained in a single microphone housing, wherein each transducer has a different polar pick-up pattern. The system includes a remote combiner for the symmetrical addition of the output of each transducer into a composite signal of variable pattern. In the illustrated implementation, the system includes an electret microphone capsule having an omnidirectional pick-up pattern, an electret microphone capsule having a cardioid pick-up pattern, and an electret microphone capsule having a hypercardioid pick-up pattern. The capsules each have a mechanical acoustic phase shifting element to produce the desired pick-up patterns and are time aligned in the housing by placing the capsules together at the same location while pointing in the same direction. Each capsule has an independent power supply module and adjustable gain amplifier for the acoustical balancing of the system which is also integrally contained in the microphone housing. The combiner is shown implemented as a resistive switching network allowing the selection of multiple patterns, and alternatively, as a number of rheostats connected at a common node thereby providing an infinitely variable selection of patterns.

14 Claims, 7 Drawing Sheets

VARIABLE PATTERN MICROPHONE SYSTEM

FIELD OF THE INVENTION

The present invention pertains generally to an improved variable pattern microphone system and is more particularly directed to a microphone system having a plurality of sound transducers with different polar pick-up patterns.

BACKGROUND OF THE INVENTION

There are a number of previous designs for microphones having directional beam patterns. Various microphones of a single transducer design are known to have omnidirectional beam patterns, while others are known to have unidirectional (cardioid) beam patterns, and while still others are known to have superdirectional (hypercardioid) beam patterns. These single transducer microphones are relatively inflexible in situations where sound sources are moving about and changing position in the pick-up pattern. The omnidirectional microphone generally picks up unwanted sound sources whereas the directional microphones may eliminate some sound sources that are desired to be heard.

To alleviate this problem microphones with electronically controllable beam direction were developed. Microphone arrays which are controlled as to beam direction are now conventional and generally include various numbers of unidirectional microphones which are phased and combined to provided an electronically controlled beam pattern. Such arrays can be electronically focused on a particular area to either include or exclude various sound sources.

As an example, U.S. Pat. No. 4,485,484 to Flanagan discloses a directional microphone system which arranges microphones so as to focus them on a prescribed volume in a large room such as an auditorium. As disclosed, the system by Flanagan is designed to only accept signals which emanate from the prescribed volume and to reject any signals which are received from outside the prescribed volume. The system utilizes two microphone arrays wherein the first array is placed along a first wall and the second array is placed along a second wall, or is placed on the first wall and spaced a predetermined distance away from the first array. A separate position locator is employed which determines the position of the speaker. The system is not ideal due to the phase interference that occurs between the transducer signals. If the microphone arrays are not an equal distance from the sound source location, the resulting signals are not uniform in sensitivity for all points within the desired focal volume.

Moreover, for those array systems which electronically align the phases of each element, the simultaneous control of the directivity of the pick-up pattern and gain of each element is problematical. During a program with moving sound sources where, for example, some sources are desired to be included and some sources are desired to be excluded, not only is the directivity but the gain of the system output important. But it has proven extremely difficult and expensive to produce an array of unidirectional transducers which can be phased correctly for significant directivity across the entire spectrum of gains which are desirable. Additionally, because of the complex relationship of each signal in an array with the others for phase alignment, a program manager cannot easily control the directivity and gain for such arrays simultaneously without noticeable discontinuities to an audience.

SUMMARY OF THE INVENTION

These and other problems in the art of directional microphones are solved by the invention which provides an improved variable pattern microphone system.

It is an object of the invention to provide an improved variable pattern microphone system including a plurality of sound transducers, each having a different polar pick-up pattern.

Another object of the invention is to provide an improved variable pattern microphone system which includes means for equalizing the acoustical balance and phase alignment between a plurality of sound transducers prior to their combination.

In a preferred embodiment, the variable pattern microphone system comprises a microphone housing integrally containing a plurality of acoustically balanced and time aligned microphone elements, each having a different polar pick-up pattern. A three element microphone system includes a first pick-up element having an omnidirectional pattern, a second pick-up element having a cardioid pattern, and a third pick-up element having a hypercardioid pattern.

In the illustrated implementation, each pick-up or microphone element comprises a capsule containing a sound transducer of the electret type. These sound transducers have a variable capacitance which is responsive to the longitudinal pressure waves of sound. The different polar pick-up pattern for each capsule is formed by a mechanical acoustical phase shifting element contained in the capsule. Because the phase shifting or time alignment of a signal is done mechanically for each capsule before the transduction of the pressure waves into an electrical signal and because the capsules are in a single housing at essentially the same location and pointing in the same direction, the three electrical signals from the microphone capsules are essentially in phase alignment with each other without any further electronic processing. Acoustical balance for each channel is achieved by having each capsule powered by an independent circuit means integrally contained in the microphone housing and including a power supply and balancing circuit.

When each capsule signal has been phase aligned and balanced, the output signal of each capsule can be symmetrically combined with the others to change the pick-up pattern of the overall system. According to the invention, a remote combiner using variable impedances is utilized to take portions of the signal from each independent channel to form a composite output signal. The combiner is located remotely from the microphone housing to allow an operator to control a program without any visible intervention. The variable impedances of the combiner are preferably resistive elements which form an additive linear combination of the signals. Resistive elements produce no phase shift and permit the pattern gain to vary in a predictable manner.

In a first preferred embodiment, the combiner comprises a plurality of switching means which are connected to provide selective combinations of the capsule signals, with or without attenuation. In a second preferred embodiment, the combiner comprises a plurality of infinitely variable resistors which are connected commonly at a summing junction, such that the independent capsule signals can be combined in an infinite variety of proportions. Such embodiments of the combiner can be implemented as three separate channels of a mixing board remote from the microphone housing.

Manifestly, the signal combination is made transparent to a listener because the linear combination circuitry will not produce phase shifts or an unbalancing of the components of the combined signal. The output for each channel is substantially linear across the entire gain of the system and can easily be combined in any proportion with a single other channel, or any combination of the multiple channels. The switching between different patterns does not cause a disruption in the program or noticeable variation in the sound because of the time alignment and balance of each separate signal with the others. Smooth transitions between sound sources at various positions in the pick-up pattern and even while they are moving can be made in this manner.

These and other objects, features and aspects of the invention will be better understood and more fully described upon reading the following detailed description in conjunction with the appended drawings wherein:

DETAILED DESCRIPTION OF THE PREFERRED EMBODIMENTS

Figure 1:
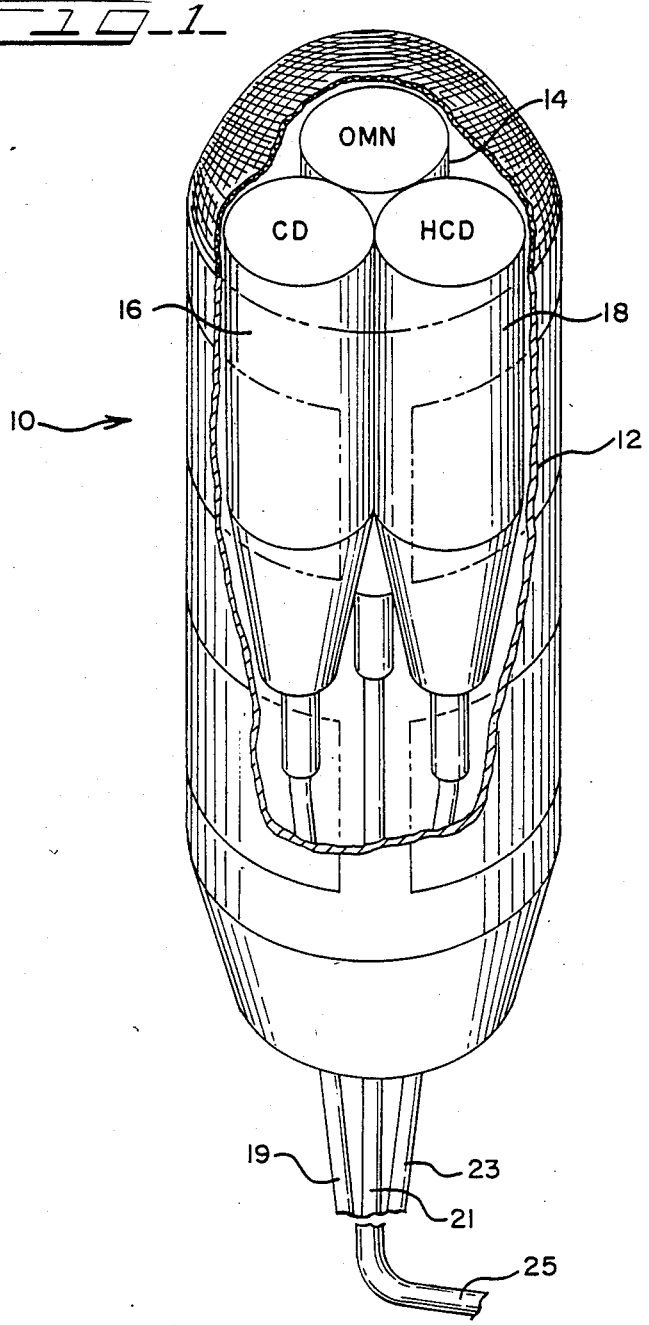
FIG. 1 is a partially cross sectioned pictorial view of a microphone, housing integrally including a plurality of sound transducers and balancing circuits.

With reference now to FIG. 1, there is illustrated a microphone 10 as a unitary structure having a housing 12 integrally containing a plurality of sound transducers, each having a different polar pick-up pattern. In the preferred embodiment, the housing 12 contains three different sound transducers including a first transducer 14 with an omnidirectional pick-up pattern, a second transducer 16 with a unidirectional pick-up pattern (cardioid) and a third transducer 18 with a superdirectional pick-up pattern (hypercardioid). The microphone housing 12 also integrally contains an independent power supply and balancing circuit for each transducer, as will be more fully detailed hereinafter.

Each of the transducers 14, 16 and 18 are independent channels that selectively pick up surrounding sound sources depending upon their particular beam pattern. The sound transducers in the form of electret capsules are situated in the housing 12 at substantially the same location and point in the same direction. Longitudinal pressure waves from the sound sources within the pick-up pattern of the transducers 14, 16, and 18 are converted into electrical signals and input to remote combination circuitry via connecting lines 19, 21 and 23, respectively, which form a microphone cable 25. The independent electrical signals are time aligned and balanced before combination thereby allowing a significant reduction in the complexity of the combination circuitry.

Figure 2:
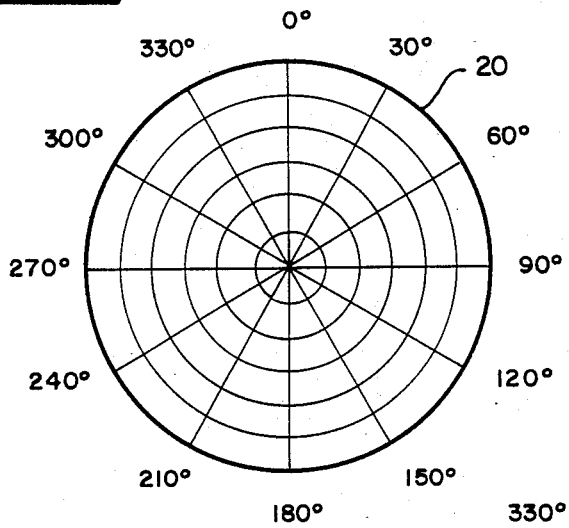
FIG. 2 is a pictorial representation of the polar pick-up pattern of the omnidirectional transducer illustrated in FIG. 1.
Figure 3:
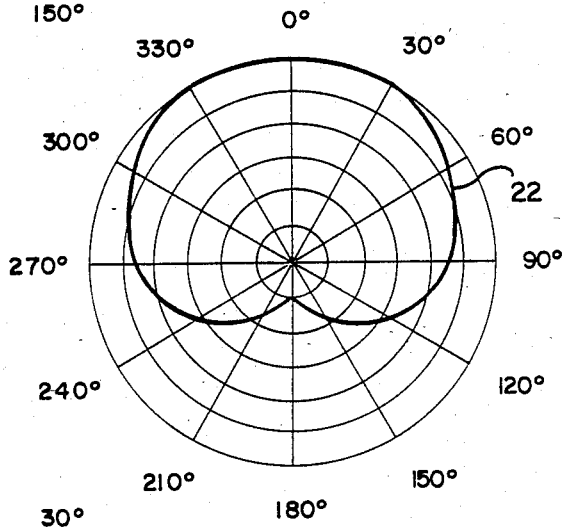
FIG. 3 is a pictorial representation of the polar pick-up pattern of the cardioid transducer illustrated in FIG. 1
Figure 4:
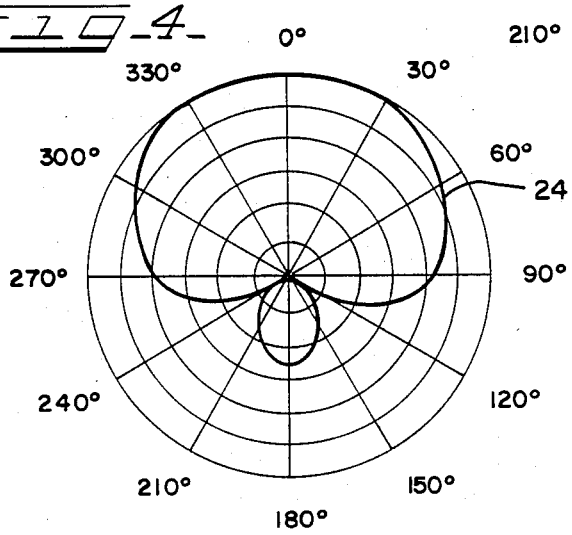
FIG. 4 is a pictorial representation of the polar pick-up pattern, of the hypercardioid transducer illustrated in FIG. 1.

FIG. 2 shows the polar pattern for the omnidirectional transducer 14 where the outer range of the pattern is shown as a solid ring 20. The outer range of the pattern 32 indicates where the signal is down −30 db from a source at the center of the graph (the location of the microphone 10). In a similar manner, FIG. 3 illustrates the cardioid or heart shaped pattern of the transducer 16 as a solid line 22. The hypercardioid pattern of transducer 18 is illustrated in FIG. 4, wherein the outer range of the pattern is delineated by solid line 24. The graphical representations of the omnidirectional, cardioid, and hypercardioid patterns in FIGS. 2, 3 and 4 are on the same scale, i.e., each segment of the polar circle is −5 db/segment where each segment is calibrated in distance, usually 1 meter/segment.

Figure 5:
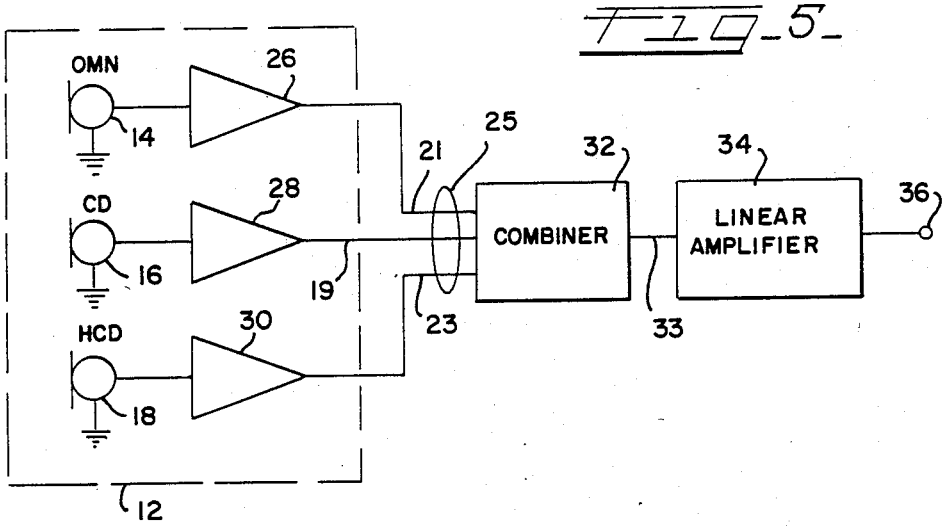
FIG. 5 is a system block diagram of a variable pattern microphone system which is constructed in accordance with the invention.

With reference now to FIG. 5, there is illustrated a block diagram of a variable pattern microphone system constructed in accordance with the invention. Each of the output signals from the microphone transducers 14, 16 and 18 are phase aligned in the capsules; and then acoustically balanced in independent equalizing means 26, 28 and 30 before being input to a combiner 32 via the microphone cable 25. All three individual inputs are combined, in a manner hereinafter described, in combiner 32 and then may be output at terminal 33 to an audio transducer, such as a speaker. Alternatively, the signal from combiner 32 may be amplified in a linear amplifier 34 prior to its output at terminal 36.

The configuration of the system advantageously includes the microphone 10 as an integral unit which generates three acoustically balanced and phase aligned signals with different polar pick-up patterns. These three signals OMN, CD, HCD are transmitted through the microphone cable 25 to a remote location where an operator of the combiner 32 can symmetrically select the proportions of each signal which will form the composite signal. The linear combination of signals which can be made with the combiner and its remote position allow an operator to easily control the selection of the pick-up pattern while observing the movement of the sound sources. This permits total program control in a facile manner.

Figure 6:
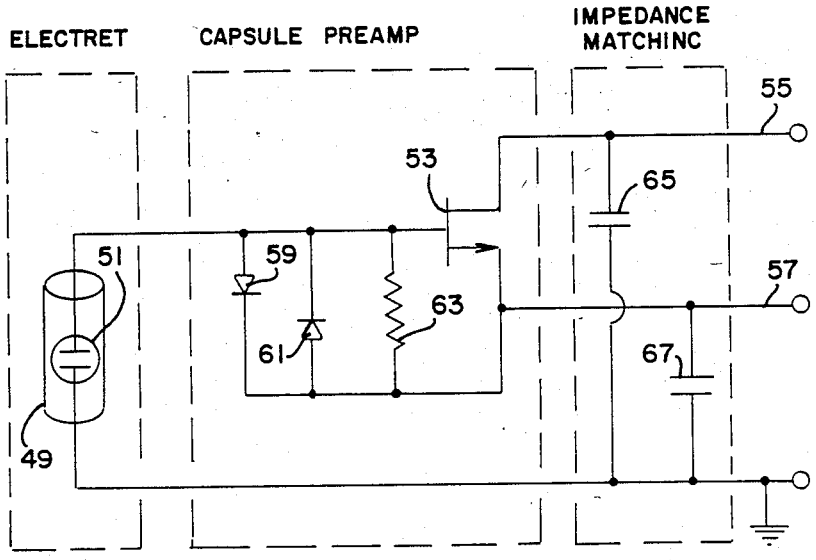
FIG. 6 is a detailed electrical schematic diagram of the electret, preamplifier, and impedance matching circuitry for one of the capsules illustrated in FIG. 1.

FIG. 6 illustrates a detailed electrical schematic of one of the capsules, for example, capsule 14. Each capsule comprises the variable capacitance 51 of the electret, one terminal of which is connected to a capsule preamplifier and the other terminal of which is connected to the shield ground. The mechanical phase shifting element 49 of each capsule which gives the transducer its directivity, is illustrated schematically.

The capsule preamplifier includes a field effect transistor (FET) connected in a differential output mode with its source providing one output 55 and its drain providing another output 57. A biasing network including back to back diodes 59 and 61, and resistor 63 maintain the gate to drain voltage at approximately 0.6V. DC bias for preamplifier is applied through output 55 as will be discussed hereinafter. Impedance matching capacitors 65 and 67 are connected between the differential outputs 55 and 57, respectively, and ground.

Figure 7:
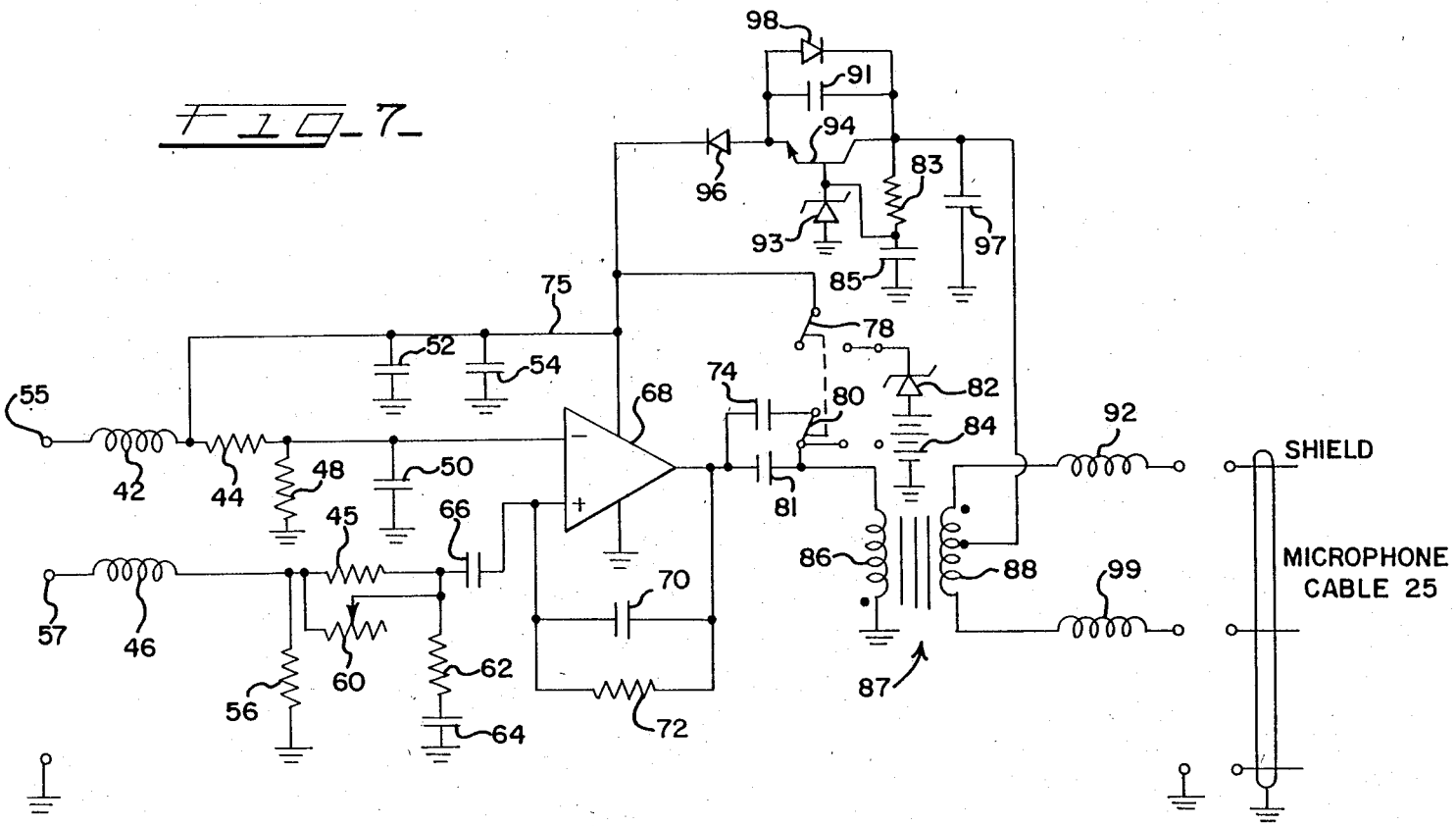
FIG. 7 is a detailed electrical schematic diagram of one of the equalizing means illustrated in FIG. 5.

FIG. 7 is a detailed electrical schematic of one of the equalizing means, for example equalizing means 26, which performs the acoustical balancing of the individual signals from the transducers. Each equalizing circuit comprises an audio input section which feeds an operational amplifier 68 and an output section comprising an audio transformer 87 which drives a balanced secondary 88. Input to the operational amplifier 68 is from the differential input leads 55, 57 connected to the impedance matching network of the electret capsule 14.

On one differential lead 55, an rf choke 46 feeds the audio signal to a divider network comprising resistors 56 and 45. A variable resistor 60 is paralleled with resistor 45 to change the impedance and thus gain of this leg of the circuit. The variable resistor 16 acts as one of the balance controls for the system. Coupling capacitor 66 connects the audio signal across resistor 45 to the noninverting input of the operational amplifier 68. The gain of the amplifier 68 is set by the ratio of resistor 72 and the input impedance of the differential lead which feeds the noninverting input. A capacitor 70 is paralleled with the resistor 72 to provide a frequency sensitive gain control which provides high frequency compensation. The other differential leg of the operational amplifier 68 is provided with the audio signal through an rf choke 42 and a pair divider resistors 44 and 48. The common connection of the divider resistors 44 and 48 is coupled with a filter capacitor 50 which feeds the inverting input of the operational amplifier 68.

The differential inputs are then amplified by the gain of the operational amplifier 68 and coupled to the output of the primary of transformer 86 through a parallel pair of coupling capacitors 74 and 81. In general, capacitors 74 and 46 combine to provide a total capacitance. However, the capacitor 74 may be switched out of the circuit thereby changing the capacitance of the coupling to that of the capacitor 81 alone. Such switching is available via a switch 80 for frequency compensation to provide greater low frequency roll off of the audio signal. The audio signal from the electret capsule 14, after amplification, is transformed in transformer 87 on a one to one basis nd then output differentially from secondary 88 to terminals 93 and 95 via rf chokes 92 and 99, respectively.

DC power for the electret capsule 14 and operational amplifier 68 is provided by a power line 75 which is filtered by two filter capacitors 52 and 54 connected between the power line and ground. The DC power for these two circuits comes alternatively from a battery 84 which is switched into the circuit via a switch 78 and which is regulated by Zener diode 82, or from an external DC source which is provided through the center tap of the secondary winding 88 of transformer 87. The external DC power source is regulated by a series NPN transistor 94 which has its collector tied to the center tap of the secondary winding 88 and its emitter connected to the power line 75 through a blocking diode 96. The bias voltage for varying the impedance between collector and emitter of transistor 94 is provided via a resistor 95 and Zener diode 93 tied to the base of the transistor. A bypass capacitor 85 and resistor 83 are connected in parallel with the Zener diode 93. Compensating capacitor 91 and blocking diode 98 are paralleled between the collector to emitter path of the transistor 94.

The switch 78 and switch 80 are preferably ganged together and can be set such that in a first position, the circuit is configured for n external power supply without low frequency compensation, in a second position for a battery power supply without low frequency compensation, and in a third position for a battery power supply with low frequency compensation.

The balancing circuits 26, 28 and 30 are used to equalize the outputs for the individual channels so that they may be more easily combined. Variable resistors, for example, the resistor 60 in FIG. 7, are used to adjust the output of each channel such that the polar patterns are gain matched as is shown in FIGS. 2, 3 and 4. When the pick-up patterns are equalized in this manner, a linear combination of the signals is available to proportionally vary to total or combined pick-up pattern in a facile manner.

Figure 8:
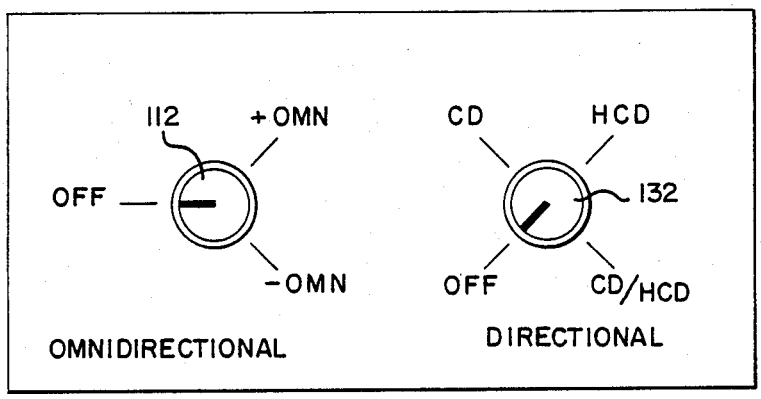
FIG. 8 is a pictorial representation of the front panel of a first embodiment of the combiner illustrated in FIG. 5.
Figure 9:
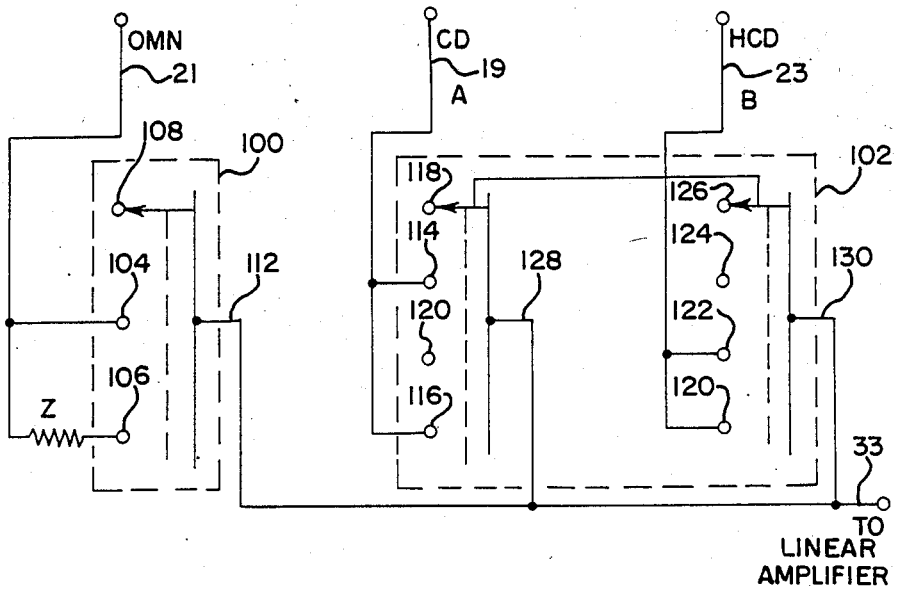
FIG. 9 is a detailed electrical schematic of the first embodiment of the combiner illustrated in FIG. 5.

FIGS. 8 and 9 illustrate the front panel controls and a detailed electrical schematic, respectively, for a first embodiment of the combiner 32. The outputs from each equalizing means are input to a plurality of switch contacts of two switching means of combiner 32. The combiner 32 includes a single pole, triple throw (SP3T) switch 100 and a dual pole, four throw (DP4T) switch 102. Two switching contacts 104, 106 of switch 100 are connected to the first equalized output from the omnidirectional transducer 14. The first contact 104 is connected directly and the other 106 connected through an attenuating impedance Z to the signal OMN. The third switching contact 108 of switch 100 is unconnected. The pole contact 112 for the switch 100 is connected to a common node 33 which becomes the output of the combiner 32. The physical switching mechanism is preferably a rotary switch having a control knob 112 which, depending upon the set position of the knob illustrated in FIG. 7, provides the full omnidirectional pattern signal +OMN, or the omnidirectional pattern signal −OMN attenuated by the impedance Z, 36 preferably −3 db. The third position is off for the switch 100.

The second equalized output from the cardioid transducer CD is connected to the switching contacts 114, 116 on side A of the switch 102 while the third equalized output from the hypercardioid transducer HCD is connected to the switching contacts 120, 122 for the side B of the switch. The switching contacts 118 and 120 of side A and the switching contacts 124 and 126 of side B of switch 102 are not connected. The two pole contacts 128 and 130, for switch 102 are connected to the common node 33.

Thus, as illustrated in FIG. 8, a control knob 132 has four output positions for signals to the common node 33 from switch 102. The first position is off as shown. In 13 another case, the equalized cardioid signal CD is provided to node 33 when switching contact 114 is connected to pole contact 128 and switching contact 124 is connected to pole contact 130. The hypercardioid signal HCD is provided to the common node 33 when switching contact 120 is connected to pole contact 128 and switching contact 122 is connected to pole contact 130. Finally, a combination of the cardioid and the hypercardioid signals CD/HCD is supplied to the common node 33 when switch contact 116 is connected to pole contact 128 and switch contact 120 is connected to pole contact 130.

In this manner a number of selections for combining the equalized outputs are provided. Overall, the two switches 100 and 102 provide eleven choices for a user of the combiner 32. The first three choices are the CD, HCD, or CD/HCD signals. Another three choices are provided by combining the first three choices with the +OMN signal, i.e., CD/+OMN, HCD/+OMN, or CD/HCD/+OMN. Yet another three choices are provided by combining the first three choices with the −OMN signal, i.e., CD/−OMN, HCD/−OMN, CD/HCD/−OMN. The last two selections are the −OMN, +OMN signals individually.

Figure 10:
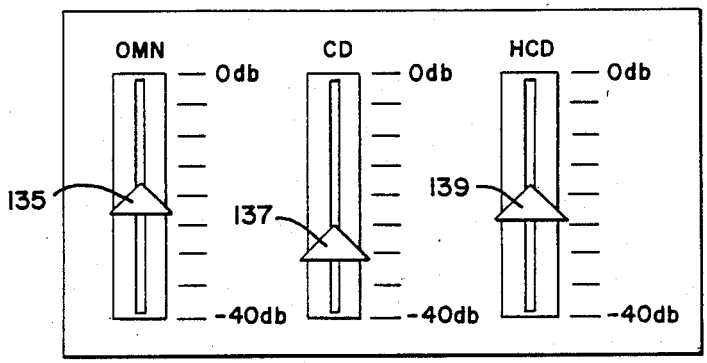
FIG. 10 is a pictorial representation of the front panel of a second embodiment of the combiner illustrated in FIG. 5.
Figure 11:
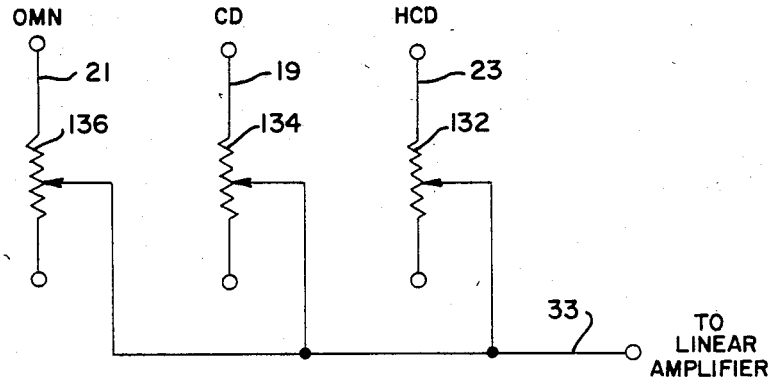
FIG. 11 is a detailed electrical schematic of the second embodiment of the combiner illustrated in FIG. 5.

An alternative embodiment for the combiner 32 is illustrated in FIGS. 10 and 11. The balanced and phase aligned signals OMN, CD, and HCD for the omnidirectional transducer, the cardioid transducer and the hypercardioid transducer on lines 21, 19 and 23 are input to the signal terminals of rheostats 136, 134 and 132. The wiper contacts for the rheostats 132, 134 and 136 are all commonly connected at the common node 33. This provides a convenient means for the linear combination of different portions of the equalized outputs into a single signal. FIG. 10 illustrates that the rheostat wipers can be the slider switches 135, 137 and 139 of three channels of a conventional mixing board which are calibrated in decibels from no attenuation (fully on) 0 db to fully attenuated (completely off) −40 db.

Figure 12:
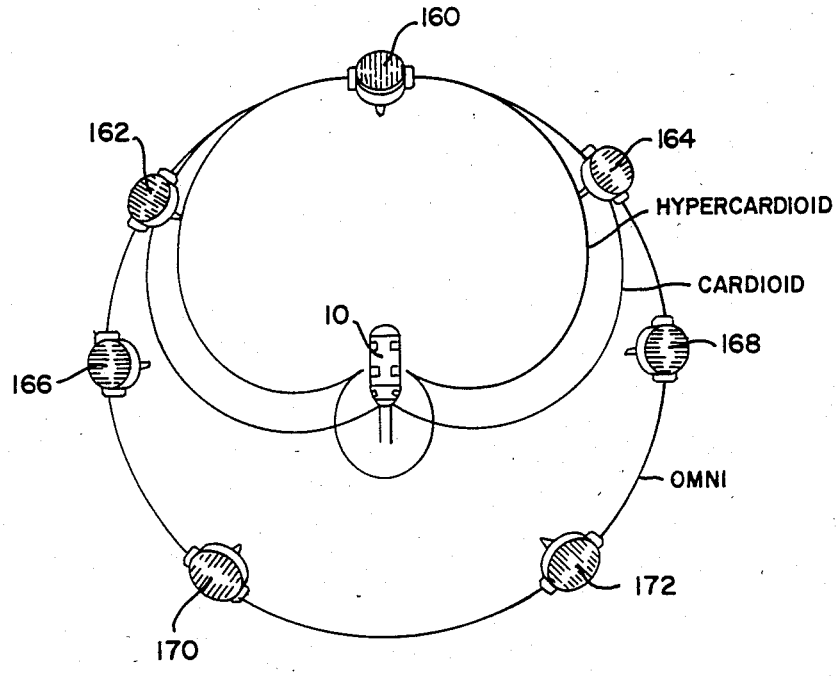
FIG. 12 is a pictorial representation of the controllable variation in the pick-up pattern of the system for one application.

FIG. 12 illustrates an application of the invention where the multitransducer microphone 10 is shown positioned on a podium with different sound sources (speakers) surrounding it. The different phase aligned and balanced polar pick-up patterns of the individual transducers are shown overlapping on one another. By selective adjustment, the total pick-up pattern can be altered such that speaker 116 may be heard while speakers 162–172 are not picked up. Alternatively, speakers 160, 162 and 164 can be fully heard while speakers 166–172 are blanked out. Additionally, all speakers 160–172 can be heard while noise outside of the pattern is substantially rejected.

This variation in pick-up pattern can be selectively made from the combiner 32 by an operator without a noticeable switching of the microphone or distortion. The pattern change is transparent and unobtrusive to an audience so that complete control can be maintained over a program without interruption and background noise. Maximum flexibility is preserved because variations in the pick-up pattern are predictable and can be changed as the sound sources (speakers) move about in the pattern area.

While a preferred embodiment of the invention has been illustrated, it will be obvious to those skilled in the art that various modifications and changes may be made thereto without departing from the spirit and scope of the invention as hereinafter defined in the appended claims.

What is claimed is:

1. A variable pattern microphone system comprising:

a first sound transducer with an omnidirectional pick-up pattern;

a second sound transducer with a cardioid pick-up pattern;

a third sound transducer with a hypercardioid pick-up pattern;

means for equalizing the phase and acoustical balance between said first transducer and said second and third transducers to produce a first equalized output;

means for equalizing the phase and acoustical balance between said second transducer and said first and third transducers to produce a second equalized output;

means for equalizing the phase and acoustical balance between said third transducer and said first and second transducers to produce a third equalized output; and means for combining said first, second and third equalized outputs to provide a combined signal having a selectable pick-up pattern from the microphone system.

2. A variable pattern microphone system as set forth in claim 1 which further includes:

means for amplifying said combined signal in the selected pattern.

3. A variable pattern microphone system as set forth in claim 1 wherein said means for combining include:

a SP3T switch having three switch contacts and a pole contact, wherein said first equalized output is connected to one of the switch contacts, said first equalized output is connected to another of the switch contacts through an impedance, and the other switch contact is not connected;

a DP4T switch having four pairs of switch contacts and two pole contacts, wherein a first pair of switch contacts are not connected, a second pair of switch contacts has one contact connected to said second equalized output and the other contact not connected, a third pair of switch contacts has one contact connected to said third equalized output and the other contact not connected, and a fourth pair of switch contacts has one contact connected to said second equalized output and the other contact connected to said third equalized output; and wherein the pole contact of said SP3T switch and the pole contacts of said DP4T switch are connected together.

4. A variable pattern microphone system as set forth in claim 1 wherein said means for combining include:

a common node;

a first variable impedance connected between said first equalized output and said common node;

a second variable impedance connected between said second equalized output and said common node; and a third variable impedance connected between said third equalized output and said common node.

5. A variable pattern microphone system as set forth in claim 1 wherein:

said first, second, and third transducers and said means for equalizing the phase and acoustical balance between said first, second, and third transducers are contained integrally in a single microphone housing.

6. A variable pattern microphone system as set forth in claim 5 wherein:

said transducer are positioned in close proximity to each other in said microphone housing.

7. A variable patter microphone system as set forth in claim 6 wherein:

said transducers are pointed substantially in the same direction in said microphone housing.

8. A variable pattern microphone system as set forth in claim 5 wherein:

said means for combining are located remotely from said single microphone housing.

9. A variable pattern microphone system as set forth in claim 8 wherein said means for combining include:

a SP3T switch having three switch contacts and a pole contact, wherein said first equalized output is connected to one of the switch contacts, said first equalized output is connected to another of the switch contacts through an impedance, and the other switch contact is not connected;

a DP4T switch having four pairs of switch contacts and two pole contacts, wherein a first pair of switch contacts are not connected, a second pair of switch contacts has one contact connected to said second equalized output and the other contact not connected, a third pair of switch contacts has one contact connected to said third equalized output and the other contact not connected, and a fourth pair of switch contacts has one contact connected to said second equalized output and the other contact connected to said third equalized output; and wherein the pole contact of said SP3T switch and the pole contacts of said DP4T switch are connected together.

10. A variable pattern microphone system as set forth in claim 8 wherein said means for combining include:

a common node;

a first variable impedance connected between said first equalized output and said common node;

a second variable impedance connected between said second equalized output and said common node; and a third variable impedance connected between said third equalized output and said common node.

11. A variable pattern microphone system having a microphone housing connected to a remote means for pattern modification by a microphone cable, wherein said microphone housing integrally includes:

a plurality of electret microphone capsules, each capsule having a variable capacitance, a preamplifier, and a mechanical phase filter means for determining the pick-up pattern of the capsule; and a plurality of equalizing means, each corresponding to a separate capsule for balancing the output signal from a respective preamplifier against those of the other capsules to produce respective first, second, and third equalized outputs;

wherein said capsules point in substantially the same direction and are positioned in close proximity to each other in said microphone housing;

wherein each of said capsules has a different pick-up pattern; and wherein said means for pattern modification includes means for linearly combining the output signals from said equalizing means.

12. A microphone system as defined in claim 11 wherein said means for combining includes:

a SP3T switch having three switch contacts and a pole contact, wherein said first equalized output is connected to one of the switch contacts, said first equalized output is connected to another of the switch contacts through an impedance, and the other switch contact is not connected;

a DP4T switch having four pairs of switch contacts and two pole contacts, wherein a first pair of switch contacts are not connected, a second pair of switch contacts has one contact connected to said second equalized output and the other contact not connected, a third pair of switch contacts has one contact connected to said third equalized output and the other contact not connected, and a fourth pair of switch contacts has one contact connected to said second equalized output and the other contact connected to said third equalized output; and wherein the pole contact of said SP3T switch and the pole contacts of said DP4T switch are connected together.

13. A microphone system as defined in claim 11 wherein said means for combining include:

a common node;

a first variable impedance connected between said first equalized output and said common node;

a second variable impedance connected between said second equalized output and said common node; and a third variable impedance connected between said third equalized output and said common node.

14. A microphone system as defined in claim 11 wherein said plurality of capsules include:

a first transducer capsule with an omnidirectional pick-up pattern;

a second transducer capsule with a cardioid pick-up pattern; and a third transducer with a hypercardioid pick-up pattern.

* * * * *